US010614987B2

(12) United States Patent
Holp et al.

(10) Patent No.: US 10,614,987 B2
(45) Date of Patent: Apr. 7, 2020

(54) FULLY INTEGRATED MANUAL OPENING MECHANISM ON MEDIUM VOLTAGE CIRCUIT BREAKER

(71) Applicant: Eaton Corporation, Cleveland, OH (US)

(72) Inventors: Tyler Louis Holp, Coraopolis, PA (US); Brad Robert Leccia, Bethel Park, PA (US); Douglas Michael Brandt, Wampum, PA (US); Paul Bottegal, Lower Burrell, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 372 days.

(21) Appl. No.: 15/807,611

(22) Filed: Nov. 9, 2017

(65) Prior Publication Data

US 2019/0139731 A1 May 9, 2019

(51) Int. Cl.
*H01H 71/52* (2006.01)
*H01H 71/32* (2006.01)

(52) U.S. Cl.
CPC ..... *H01H 71/52* (2013.01); *H01H 71/32* (2013.01); *H01H 2235/01* (2013.01)

(58) Field of Classification Search
CPC ..... H01H 71/52; H01H 71/32; H01H 2235/01
See application file for complete search history.

(56) References Cited

U.S. PATENT DOCUMENTS 2,813,950 A * 11/1957 Wilson ..... H01H 71/52 335/22
4,532,486 A * 7/1985 Terrier ..... H01H 89/08 335/13
5,422,453 A * 6/1995 Smith ..... H01H 3/3021 200/329
6,930,271 B1 8/2005 Palmieri et al.
7,545,245 B2 6/2009 Zhou et al.

* cited by examiner

*Primary Examiner* — Mohamad A Musleh
(74) *Attorney, Agent, or Firm* — Eckert Seamans Cherin & Mellott, LLC

(57) ABSTRACT

A manual opening assembly includes a manual actuator assembly. The manual actuator assembly includes a handle assembly and a number of operating levers. The handle assembly includes a handle member structured to be movably coupled to a circuit breaker housing assembly and to move between an operating position and an opening position. The handle member is operatively coupled to the number of operating levers. The number of operating levers are movably coupled to a circuit breaker housing assembly. The operating levers are structured to move between an operating position, wherein the operating levers do not operatively engage a linkage assembly, and an opening position, wherein the operating levers operatively engage the linkage assembly and move the linkage assembly from a closed, second configuration to an open, first configuration.

21 Claims, 11 Drawing Sheets

FULLY INTEGRATED MANUAL OPENING MECHANISM ON MEDIUM VOLTAGE CIRCUIT BREAKER

BACKGROUND OF THE INVENTION

Field of the Invention

The disclosed and claimed concept relates to a vacuum circuit breaker and, more specifically, to a vacuum circuit breaker including an electromagnetic actuator and a manual opening assembly.

Background Information

Circuit breakers and other such devices provide protection for electrical systems from electrical fault conditions such as current overloads, short circuits, and low level voltage conditions. Vacuum circuit interrupters include separable main contacts disposed within an insulated and hermetically sealed vacuum chamber within a housing. In one embodiment, circuit breakers include a spring-powered operating mechanism which opens electrical contacts to interrupt the current through the conductors in response to abnormal conditions or a manual opening. That is, the operating mechanism maintains the springs in a charged, i.e., compressed, state so that following an over current event, the spring energy is immediately released as part of the opening of the contacts. When the contacts were closed, the springs would be recharged so as to be ready to separate the contacts again. Thus, the energy needed to separate the contacts was stored in the operating mechanism.

In another embodiment, the operating mechanism includes an electromagnetic actuator such as, but not limited to, a solenoid. The electromagnetic actuator is controlled by an electronic control device such as, but not limited to, a programmable logic circuit. In this embodiment, the control device and/or the electromagnetic actuator draws energy from the current passing through the circuit breaker, or, from a capacitor bank or other energy storage device. When being charged, the capacitor bank or other energy storage device also drew energy from the current passing through the circuit breaker.

There is a problem with operating mechanisms that includes such a control device and/or an electromagnetic actuator; if no current is available to the circuit breaker following a contact opening event, the capacitor bank or other energy storage device cannot be charged. Thus, the operating mechanism is not prepared for a second opening event, and/or the control device cannot be used. Alternatively, the capacitor bank or other energy storage device can lose energy. When this happens, the vacuum circuit breaker cannot be placed in the open configuration when needed due to the lack of energy to operate the electromagnetic actuator and/or the control device. This is a problem because the vacuum circuit breaker needs to be placed in the open configuration if it is to be repaired or otherwise worked upon.

There is a need, therefore, for a manual opening assembly in a vacuum circuit breaker including an electromagnetic actuator. There is a further need for a manual opening assembly structured to open a circuit breaker with an electromagnetic actuated mechanism when control power and stored energy is lost.

SUMMARY OF THE INVENTION

These needs, and others, are met by at least one embodiment of the disclosed and claimed concept with includes a manual opening assembly with a manual actuator assembly. The manual actuator assembly includes a handle assembly and a number of operating levers. The handle assembly includes a handle member structured to be movably coupled to a circuit breaker housing assembly and to move between an operating position and an opening position. The handle member is operatively coupled to the number of operating levers. The number of operating levers are movably coupled to a circuit breaker housing assembly. The operating levers are structured to move between an operating position, wherein the operating levers no not operatively engage a linkage assembly, and an opening position, wherein the operating levers operatively engage the linkage assembly and move the linkage assembly from a closed, second configuration to an open, first configuration. It is understood that the linkage assembly is operatively coupled to the contacts of the circuit breaker and the configuration of the linkage assembly controls the configuration of the contacts of the circuit breaker. Thus, when the linkage assembly is moved into an open, first configuration, the contacts are also moved into an open, first configuration. Thus, the manual actuator assembly disclosed and claimed herein solves the problems stated above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
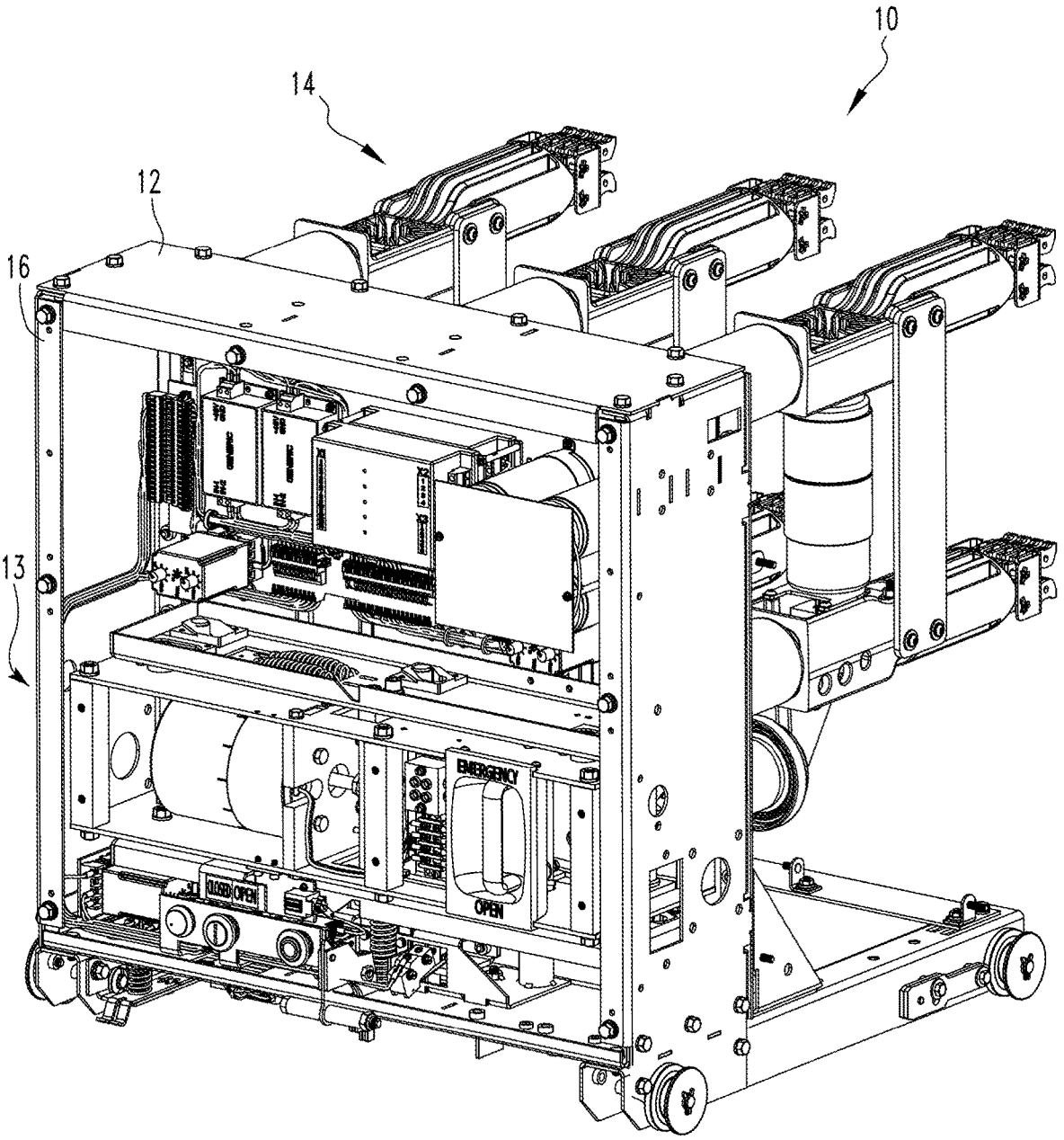
FIG. 1 is an isometric view of a vacuum circuit breaker.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners, fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, a "slot" is an elongated opening that inherently has a longitudinal axis.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, a "grip" is an element that is structured to be grasped by human fingers. Thus, a "grip" is sized, shaped, and positioned, to be grasped by a human hand. An element that is merely capable of being grasped by a human hand but which is not sized, shaped, and positioned, to be grasped by a human hand is not a "grip."

As used herein, a "magnetic member" means an element is a permanent magnet and/or a ferromagnetic element associated with a magnet. A plurality of "magnetic members" may include all permanent magnets or a combination of at least one permanent magnet and other ferromagnetic members.

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately."

As used herein, "generally" means "in a general manner" relevant to the term being modified as would be understood by one of ordinary skill in the art. As used herein, "substantially" means "for the most part" relevant to the term being modified as would be understood by one of ordinary skill in the art.

Figure 2:
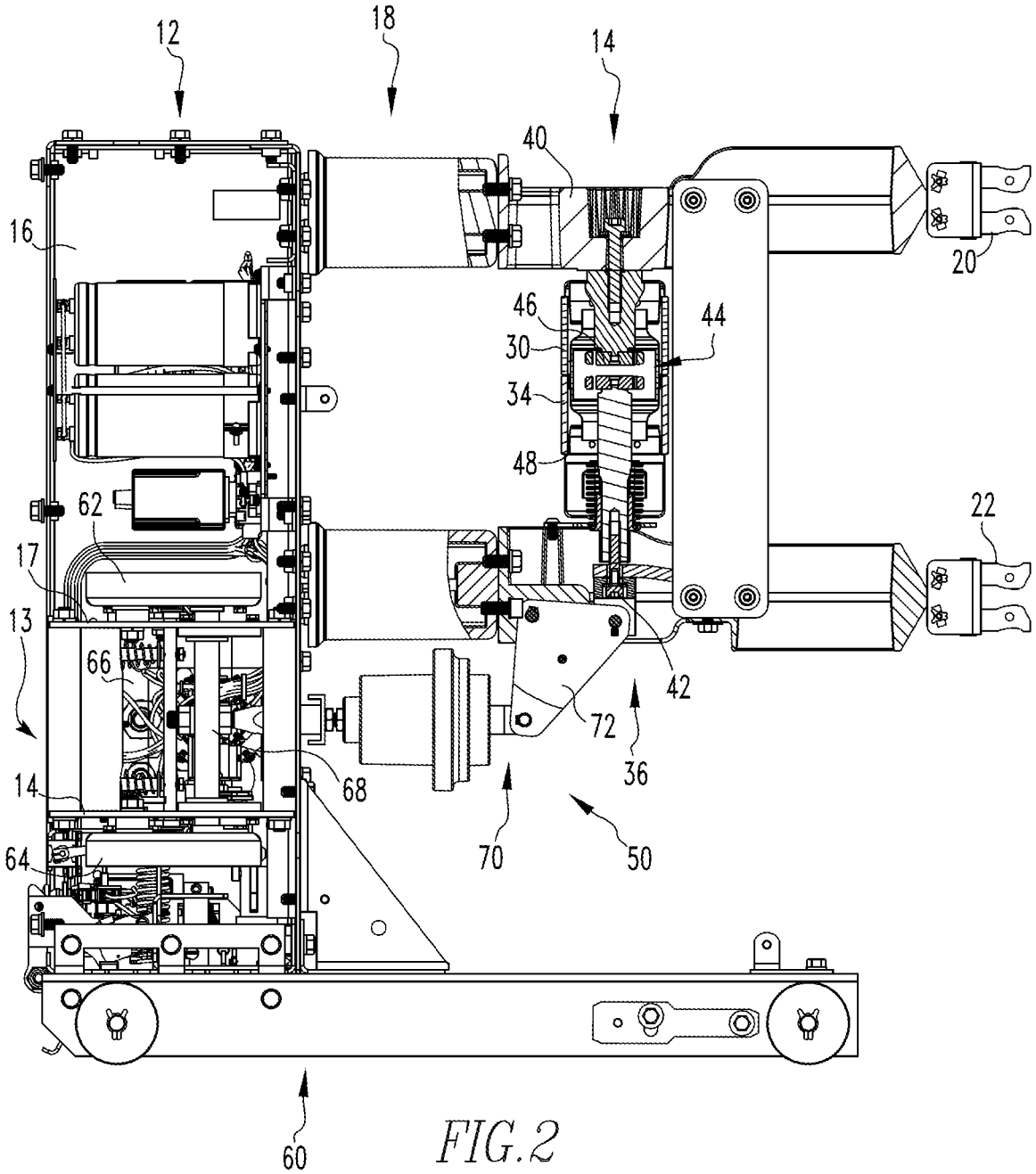
FIG. 2 is a side view of a vacuum circuit breaker.

Referring to FIGS. 1 and 2, there is illustrated a vacuum circuit breaker 10 incorporating a vacuum interrupter assembly 30. As is known, the vacuum circuit breaker 10 may be a single pole or multi-pole vacuum circuit breaker 10. Generally, hereinafter only a single pole will be discussed although the Figures show three poles. It is understood that the claims are not limited to an embodiment having only a single pole or three poles. Generally, the vacuum circuit breaker 10, in an exemplary embodiment, includes a low voltage portion 12 and a high voltage portion 14. The low voltage portion 12 includes a housing assembly 16 structured to include a control device 13 such as, but not limited to, a circuit breaker assembly and/or a control panel. In an exemplary embodiment, the housing assembly 16 includes two generally planar members, an upper planar member 17 and a lower planar member 19 (FIG. 3), that are spaced from each other and wherein the plane of the planar members 17, 19 extends generally horizontally. The control device 13 is structured to operate the vacuum circuit breaker 10 and change the state of the pairs of separable contacts 44 (discussed below) to either an open, first configuration or closed, second configuration. The low voltage portion 12 is operatively coupled to the high voltage portion 14 via stand-off supports 18. The high voltage portion 14 includes a line terminal 20, a load terminal 22, and the vacuum interrupter assembly 30. The line terminal 20 is structured to be, and is, coupled to a line (not shown). The load terminal 22 is structured to be, and is, coupled to a load (not shown).

The vacuum interrupter assembly 30, as shown in FIG. 2 and in an exemplary embodiment, includes a vacuum chamber 34 and a conductor assembly 36. The conductor assembly 36 includes a number of line side conductive members 40 and a number of load side conductive members 42 as well as a number of pairs of separable contacts 44. The pair of separable contacts 44 includes a fixed contact 46 and a movable contact 48. As is known, the line side conductive members 40 are coupled to, and in electrical communication with, the line terminal 20 and the fixed contact 46. Similarly, the load side conductive members 42 are coupled to, and in electrical communication with, the load terminal 22. Each pair of separable contacts 44 are structured to move between an open, first configuration, wherein the contacts 46, 48 in each pair of separable contacts 44 are spaced from each other, and a second configuration, wherein the contacts 46, 48 in each pair of separable contacts 44 are coupled to, and in electrical communication with, each other.

The configuration of the separable contacts 44 are controlled by an operating mechanism 50 that is, generally, disposed in the housing assembly 16. The operating mechanism 50 includes a linkage assembly 60, a bias assembly 110, and an electromagnetic actuator 130. The linkage assembly 60, in an exemplary embodiment, includes an upper output plate 62, a lower output plate 64, a yoke member 66, and a number of cross members 68 (one for each pole), as well as a number of high voltage portion links 70 that are not relevant to the disclosed and claimed concept. It is noted that the high voltage portion links 70 includes a pivoting element 72 that converts the horizontal movement of the cross members 68 to a vertical motion that moves the movable contact 48 between a lower position and an upper position, as is known.

In an exemplary embodiment, the upper output plate 62 is generally rectangular. The upper output plate 62 includes a number of cam slots 80 (one for each pole), a number of orienting slots 82 and a spring mounting 84. The longitudinal axis of the orienting slots 82 extend generally parallel to each other and generally parallel to the longitudinal axis of the upper output plate 62. The longitudinal axis of the output plate cam slots 80 extend generally parallel to each other and at an angle to the longitudinal axis of the orienting slots 82. The lower output plate 64 is substantially similar to the upper output plate 62 and includes a number of cam slots (one for each pole, not shown), a number of orienting slots and a spring mounting (none shown).

Figure 3:
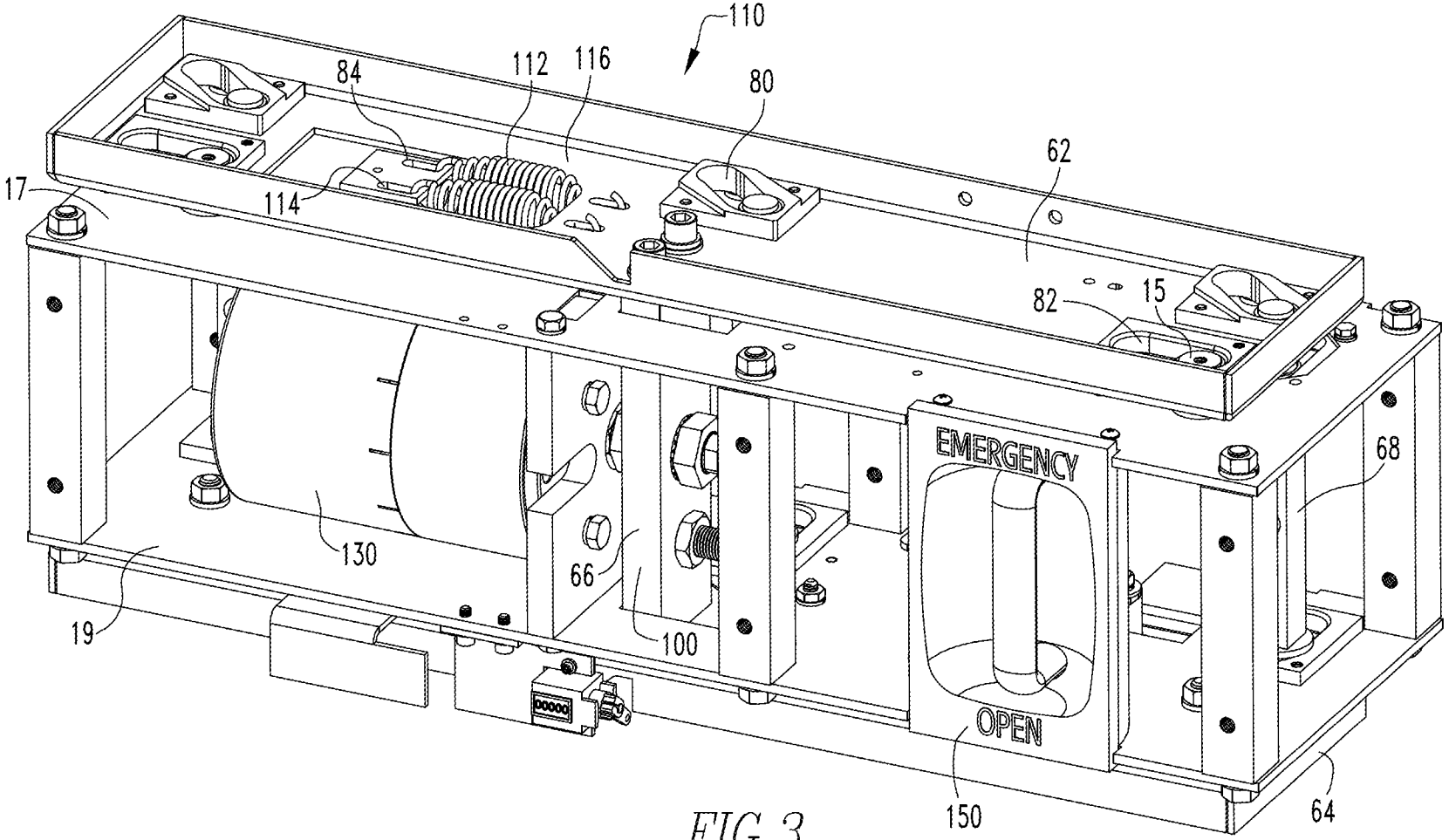
FIG. 3 is a detail isometric view of a control device.
Figure 4:
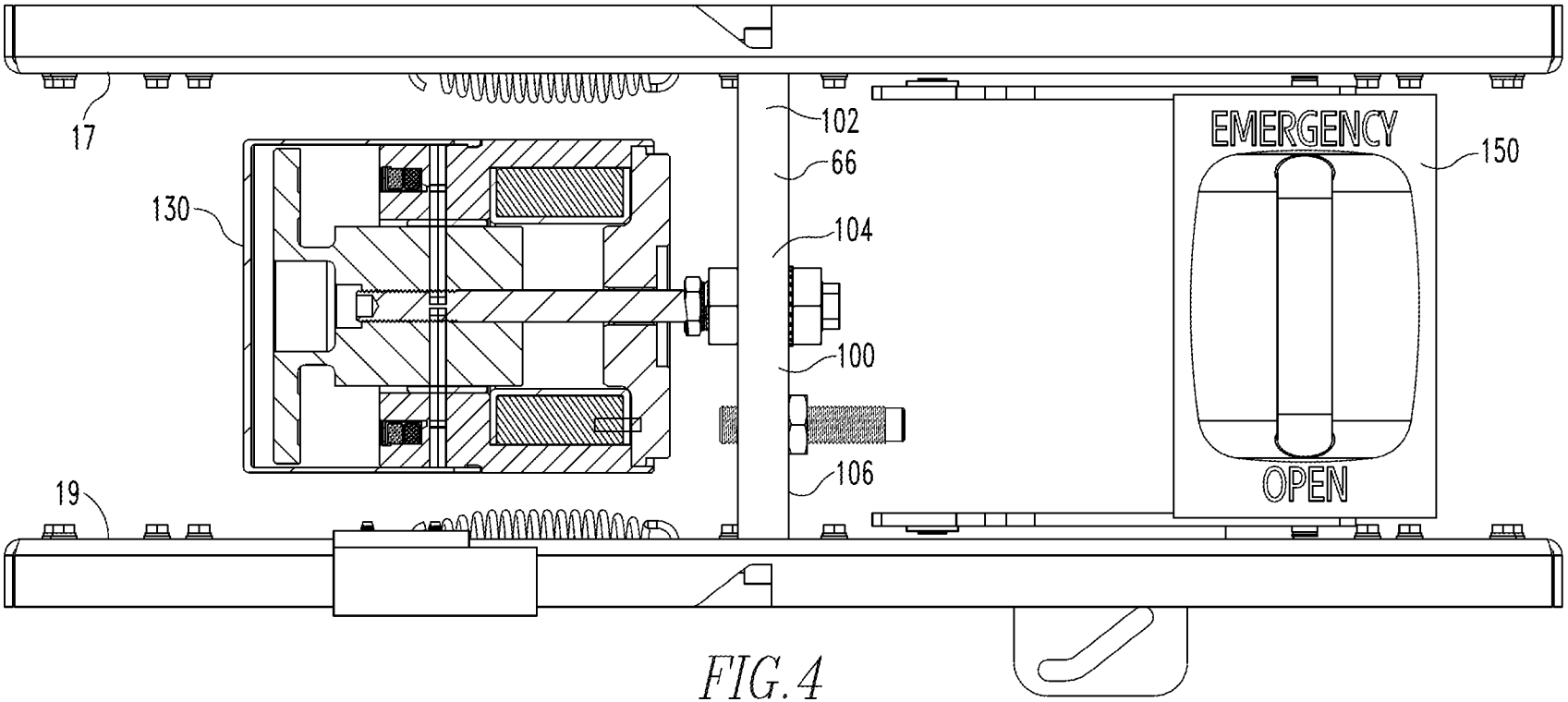
FIG. 4 is a detail side view of a control device.

The housing assembly planar members 17, 19 each include guide lugs 15 (shown on the upper planar member 17 in FIG. 3). The guide lugs 15 are sized and positioned to fit within the orienting slots 82. The guide lugs 15 have a smaller area than the orienting slots 82. The upper output plate 62 is movably coupled to the upper planar member 17 with the guide lugs 15 extending through the orienting slots 82 (as shown). In this configuration, the upper output plate 62 translates (i.e., moves while maintaining its orientation) relative to the upper planar member 17. As shown, the upper output plate 62 moves generally laterally relative to the vacuum circuit breaker 10. The lower output plate 64 is movably coupled to the lower planar member 19 in a similar manner and operates in a similar manner.

Further, it is noted that the planar members 17, 19 each include guide slots (not shown), hereinafter the "housing assembly guide slots." The longitudinal axis of the housing assembly guide slots extend generally perpendicular to the longitudinal axis of the upper and lower output plate orienting slots 82. Further, the planar members 17, 19 each include openings (not shown) sized to allow the yoke member 66 to pass therethrough as well as sized to accommodate the motion of the yoke member 66, as described below.

The yoke member 66 includes an elongated body 100 with a first end 102, a medial portion 104, and a second end 106. The yoke member first end 102 is coupled, directly coupled, or fixed to the upper output plate 62. The yoke member second end 106 is coupled, directly coupled, or fixed to the lower output plate 64. Thus, the yoke member 66 is operatively coupled to the upper output plate 62 and the lower output plate 64. In this configuration, the upper output plate 62, the lower output plate 64 and the yoke member 66 move as a unit (but not as a "unitary" body as defined above).

The number of cross members 68 are disposed generally vertically and pass through the cam slots 80 of the upper output plate 62, the lower output plate 64 and the housing assembly guide slots. The cross members 68 are movably coupled to the housing assembly planar members 17, 19, the upper output plate 62 and the lower output plate 64. For example, each cross member 68 includes a number of flanges (not numbered) that prevent the cross member 68 from passing through the cam slots 80 and the housing assembly guide slots. The flanges also maintain the cross member 68 in a generally vertical orientation. In this configuration, the upper output plate 62 and the lower output plate 64 are operatively coupled to each cross member 68.

The high voltage portion links 70 are coupled, directly coupled, or fixed to the cross members 68. That is, as is known, each pole has a similar set of high voltage portion links 70 wherein each set is coupled to one cross member 68. Thus, the cross members 68 are operatively coupled to the high voltage portion links 70. As discussed above, the high voltage portion links 70 convert the motion of a cross member 68 to a vertical motion in the movable contact 48. Thus, the linkage assembly 60 is operatively coupled to each pair of separable contacts 44. Further, the linkage assembly 60 as a whole moves between a first configuration and a second configuration, as discussed below. Further, the individual elements of the linkage assembly 60 move between a first position and a second position corresponding to the configuration of the linkage assembly 60. As used herein, when configurations/positions are "corresponding," it means that when one element is in an identified configuration/position, e.g., a "first" position, then another element is also in an identified configuration/position which is typically, but not always, identified by a similar name. That is, the other element is also in a "first" configuration/position. Further, when elements are in "corresponding" configurations/positions, when the first element moves to the other configuration/position, then the second element also moves to the other configuration/position.

In the configuration disclosed above, the upper output plate 62 and the lower output plate 64 are movably coupled to the housing assembly 16 and are structured to move between a first position and a second position. Further, as noted above, the linkage assembly 60 is operatively coupled to each pair of separable contacts 44. Thus, for identification purposes, when the upper output plate 62 and the lower output plate 64 are in the "first position," or when the linkage assembly 60 is in the first configuration, each pair of separable contacts 44 are in their first configuration, and, when the upper output plate 62 and the lower output plate 64 are in the "second position," or when the linkage assembly 60 is in the second configuration, each pair of separable contacts 44 are in their second configuration.

The bias assembly 110 is structured to, and does, bias the linkage assembly 60 to the first configuration (and therefore biases each pair of separable contacts 44 to the first configuration). In an exemplary embodiment, the bias assembly 110 includes a number of springs 112. The springs 112 each include a first end 114 and a second end 116. Each spring first end is coupled, directly coupled, or fixed to the housing assembly 16. Each spring second end 116 is coupled, directly coupled, or fixed to the linkage assembly 60 and, as shown in one embodiment to the upper output plate 62 and/or the lower output plate 64.

Figure 5:
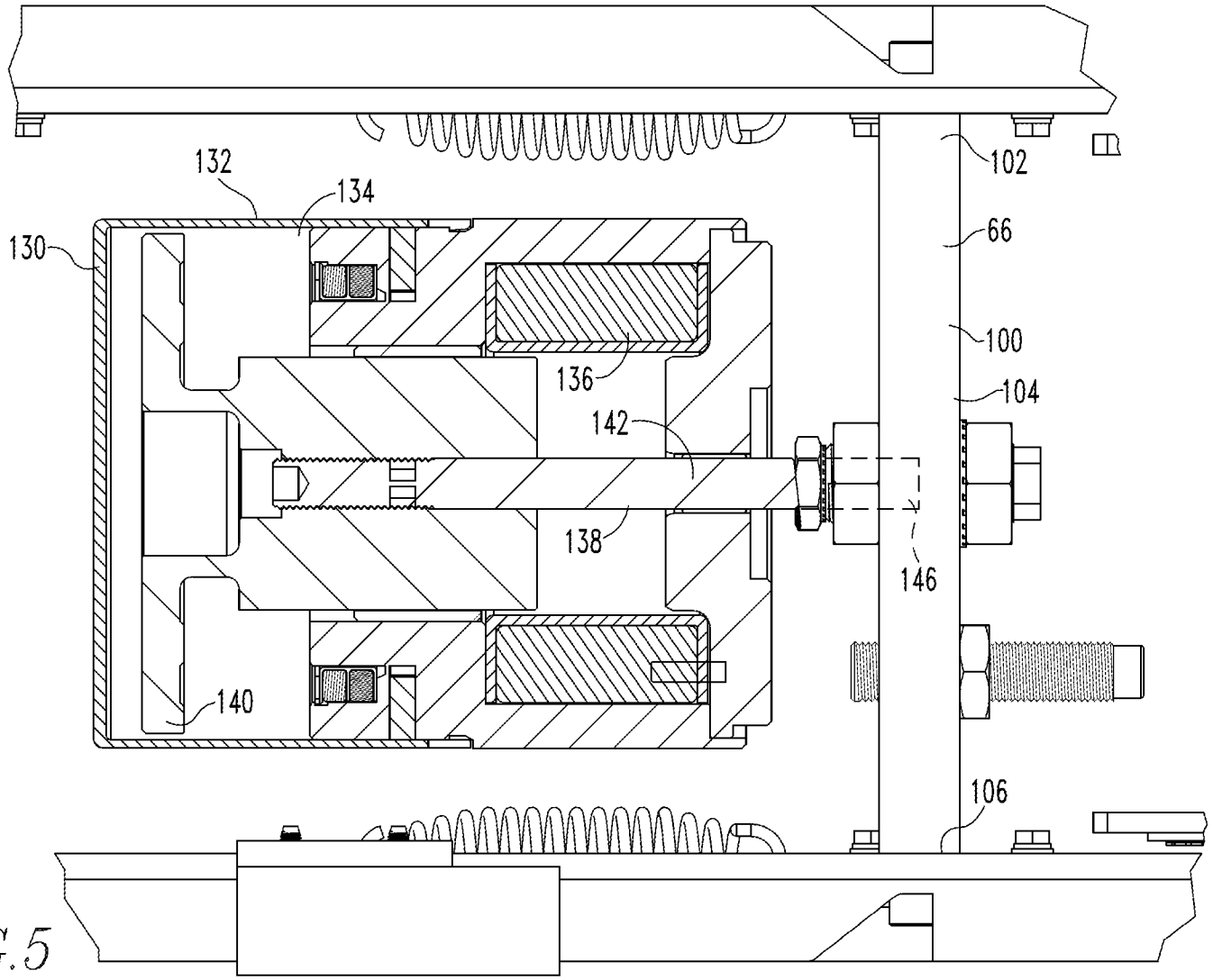
FIG. 5 is a cross-sectional side view of an electromagnetic actuator.

The electromagnetic actuator 130 is structured to, and does, selectively provide a counter force to the bias assembly 110. In an exemplary embodiment, the electromagnetic actuator 130 is a solenoid assembly, as shown in FIG. 5. Thus, the electromagnetic actuator 130 includes a housing assembly (hereinafter a "shell" 132), a fixed magnet 134, a coil 136 and an actuator assembly 138. The actuator assembly 138 includes a magnetic member 140 and an elongated actuator member 142. The actuator member 142 is a ferrous metal, i.e., a "magnetic" element as defined above. In an exemplary embodiment, the magnetic member 140 is a disk-like member and the actuator member 142 extends generally perpendicular to the plane of the magnetic member 140. The fixed magnet 134 and the coil 136 are disposed in the shell 132. As shown, in this embodiment, the fixed magnet 134 and the coil 136 are disposed immediately adjacent each other. The actuator assembly 138 is movably disposed in the shell 132 with the actuator member 142 extending through the coil 136 and partially extending through the shell 132. The actuator assembly 138 is structured to, and does, move between a first position, wherein the magnetic member 140 is spaced from the fixed magnet 134, and a second position, wherein the magnetic member 140 is magnetically coupled to the fixed magnet 134. As is known, when the coil 136 is electrified, the actuator member 142 moves through the coil 136. Thus, when the actuator assembly 138 is in the second position, the actuator assembly 138 is held in place by the fixed magnet 134. As used herein, the first and second positions of the electromagnetic actuator 130 correspond to the first and second positions of the actuator assembly 138. The end of the actuator member 142 is disposed outside of the shell 132, hereinafter the "actuator member first end" 146, is operatively coupled to the linkage assembly 60 and, in an exemplary embodiment, to the yoke member 66 at the yoke member medial portion 104. When the electromagnetic actuator 130 is in the second position, the linkage assembly 60 and the separable contacts 44 are in their second configurations. When the electromagnetic actuator 130 is in the first position, the linkage assembly 60 and the separable contacts 44 are in their first configurations.

Figure 6A:
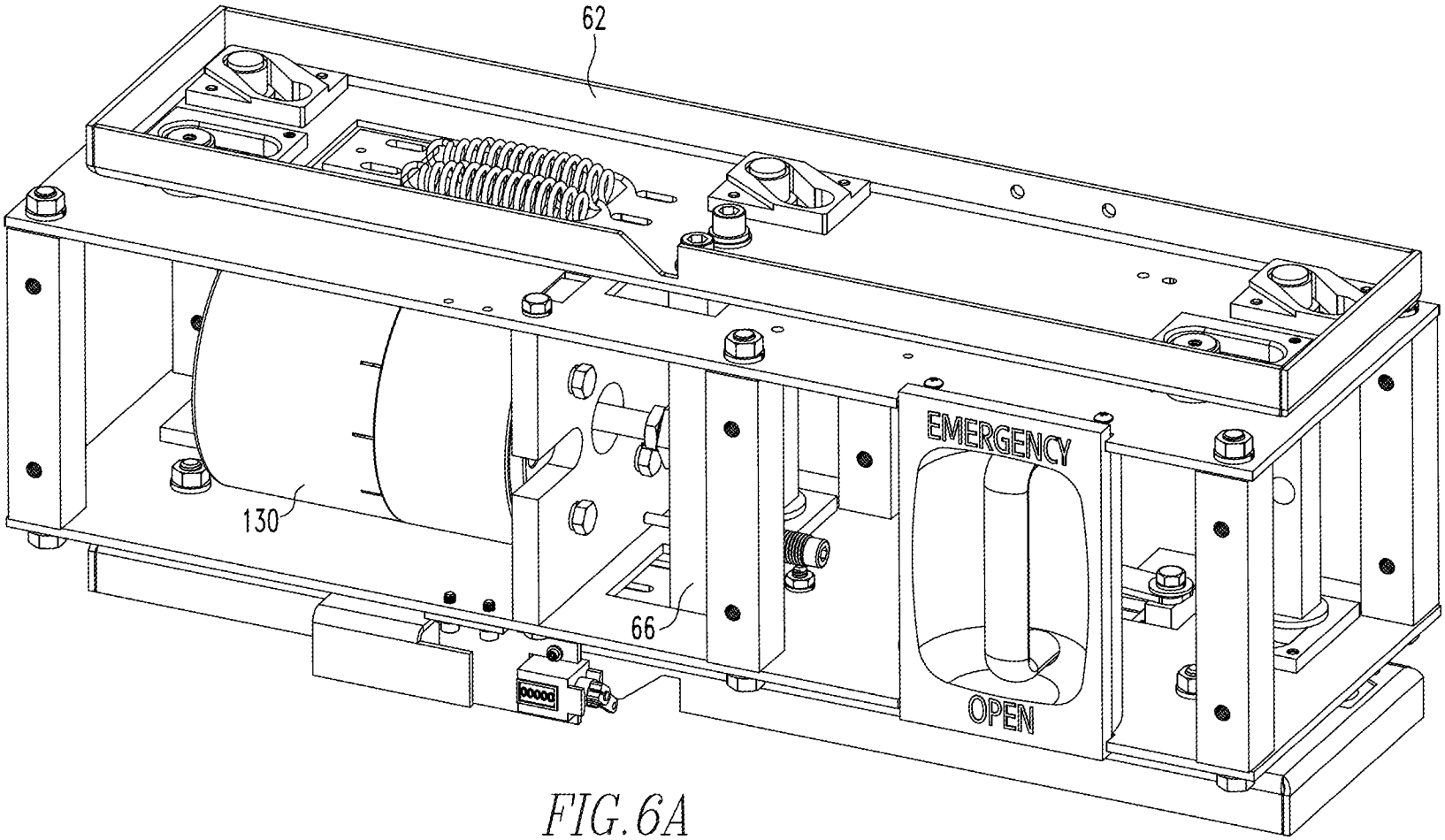
FIG. 6A is an isometric view of the control device with the linkage assembly in the second configuration.
Figure 6B:
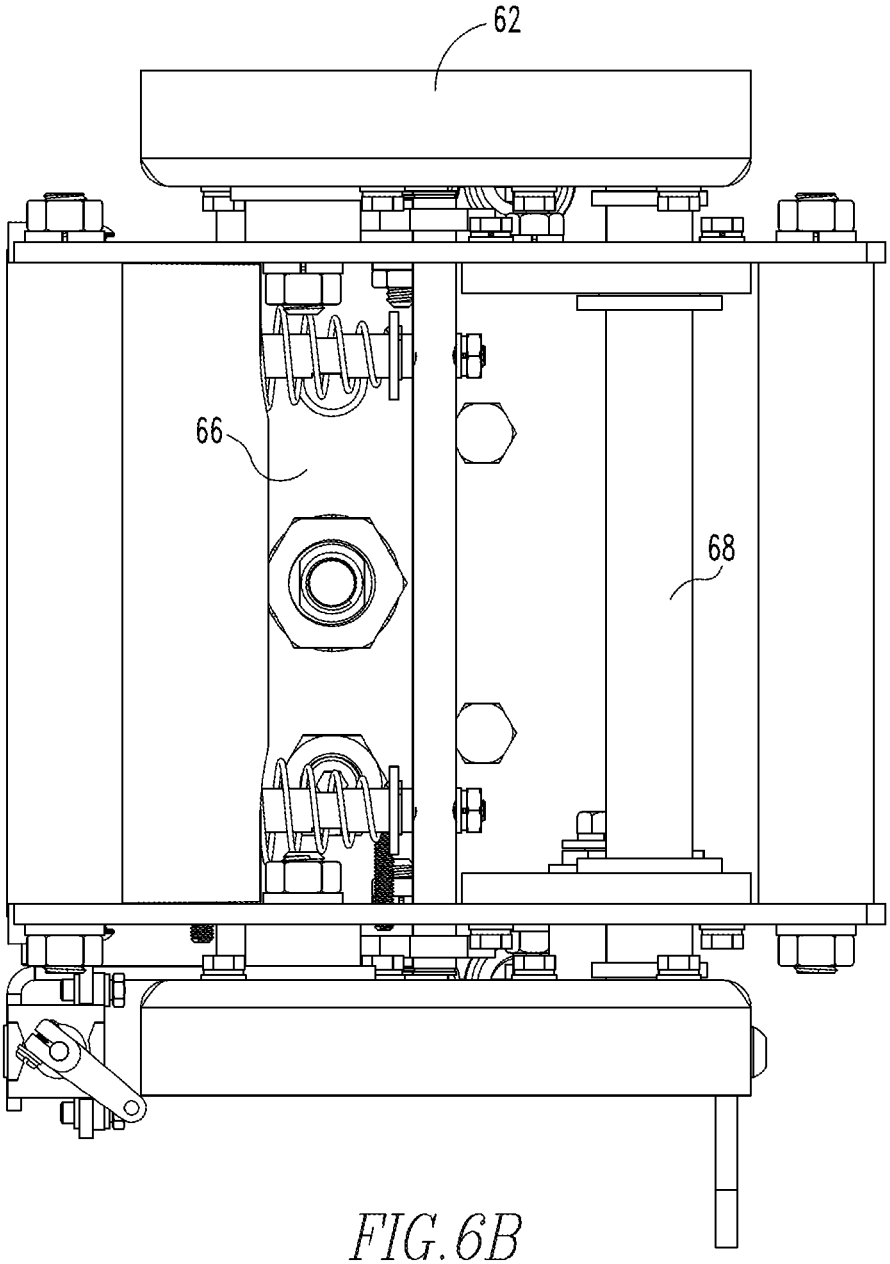
FIG. 6B is a side view of the control device with the linkage assembly in the second configuration.
Figure 7A:
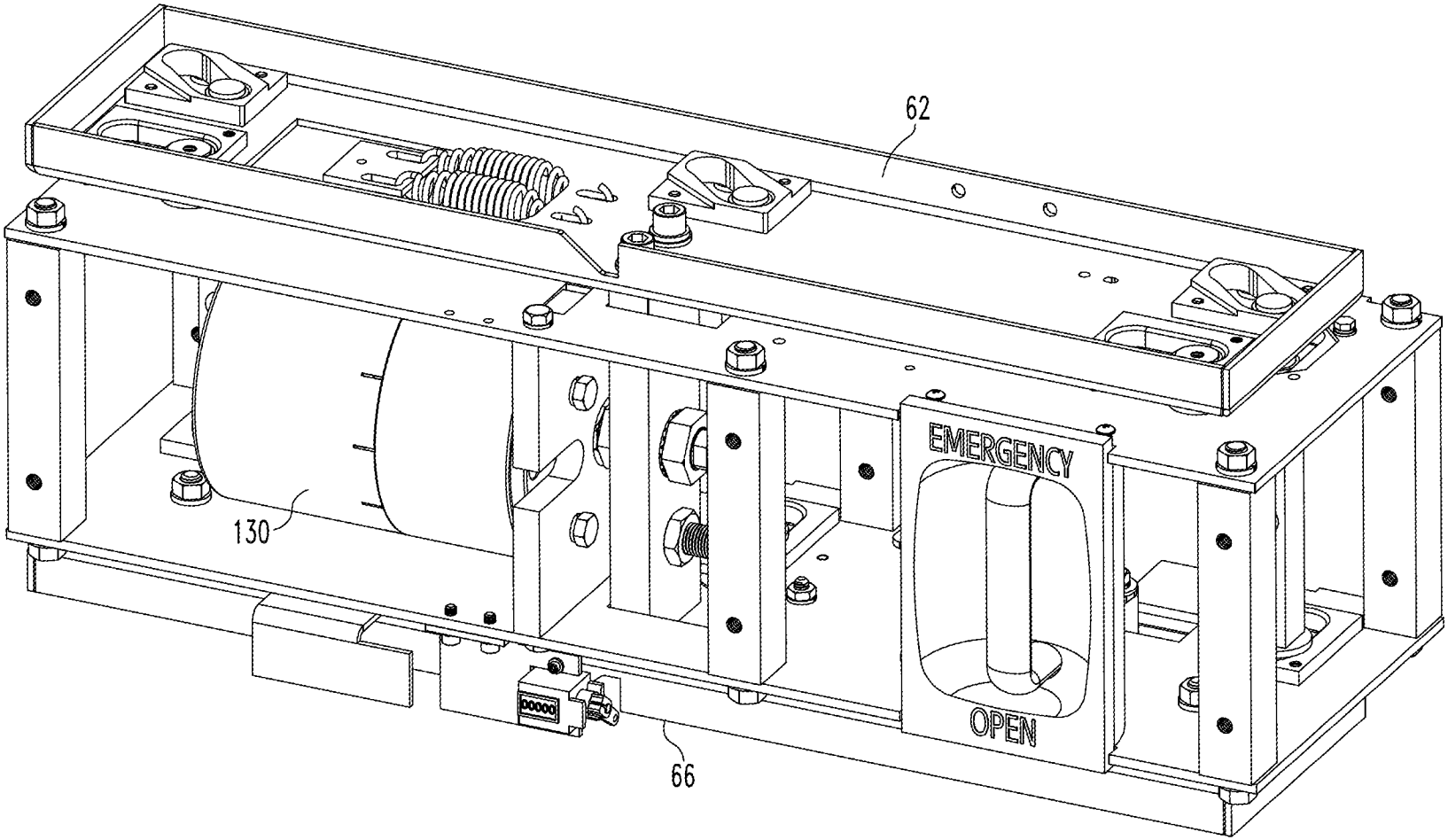
FIG. 7A is an isometric view of the control device with the linkage assembly in the first configuration.
Figure 7B:
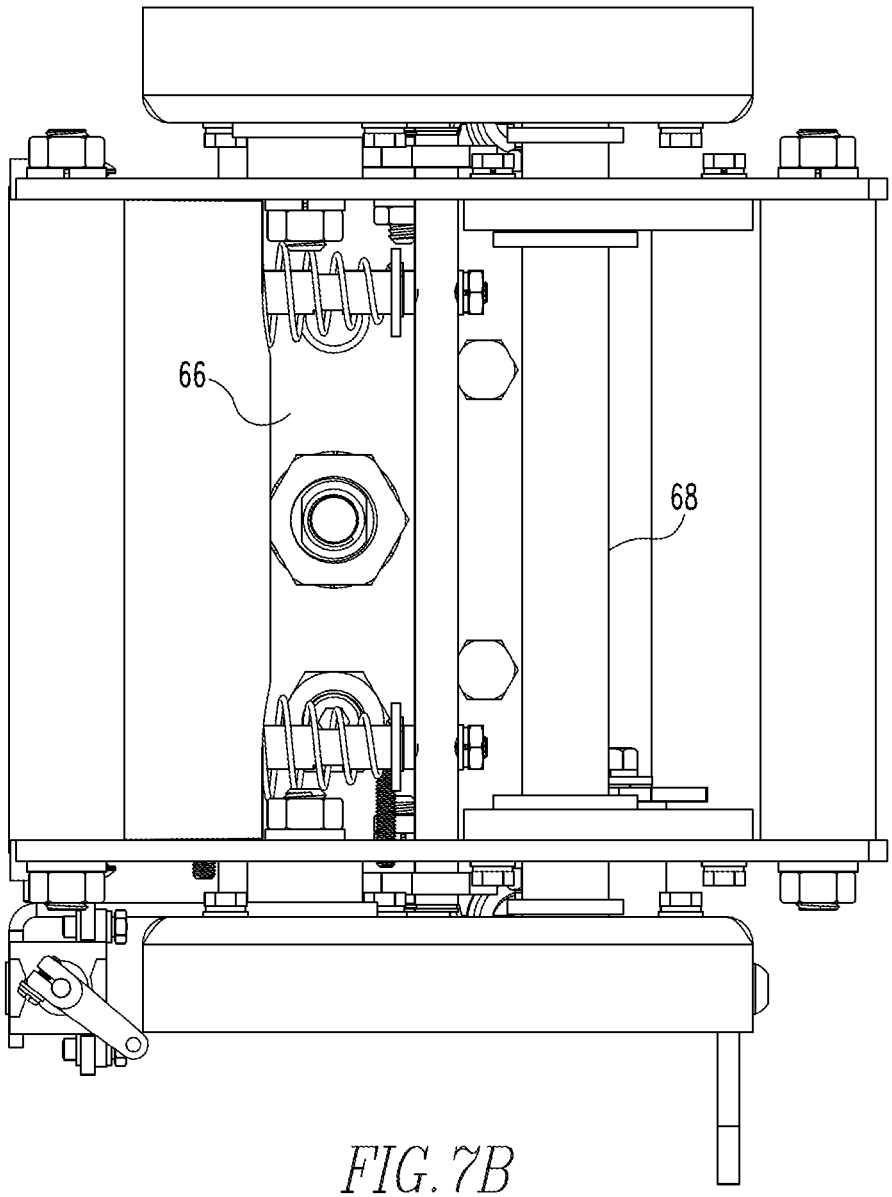
FIG. 7B is a side view of the control device with the linkage assembly in the first configuration.

The force of the bias assembly 110, acting through the linkage assembly 60, acts on the actuator assembly 138. The force of the attraction between the magnetic member 140 and the fixed magnet 134 balances, i.e., is substantially equal to, the force of the bias assembly 110. Thus, when the electromagnetic actuator 130, the linkage assembly 60 are in the second configuration, as shown in FIGS. 6A and 6B, the separable contacts 44 are in their second configuration and the contacts 44 are in electrical communication. This is the operating configuration of the vacuum circuit breaker 10. When the electromagnetic actuator 130 is operated, i.e., when the coil 136 is electrified, the electromagnetic actuator 130 moves toward the first position. When the magnetic member 140 and the fixed magnet 134 are no longer magnetically coupled, the force from the bias assembly 110 causes the electromagnetic actuator 130 and the linkage assembly 60 to move to the first configuration, as shown in FIGS. 7A and 7B. In turn, the linkage assembly 60 moves the separable contacts 44 to the first configuration. That is, actuating the electromagnetic actuator 130 causes the separable contacts 44 to open.

Figure 8:
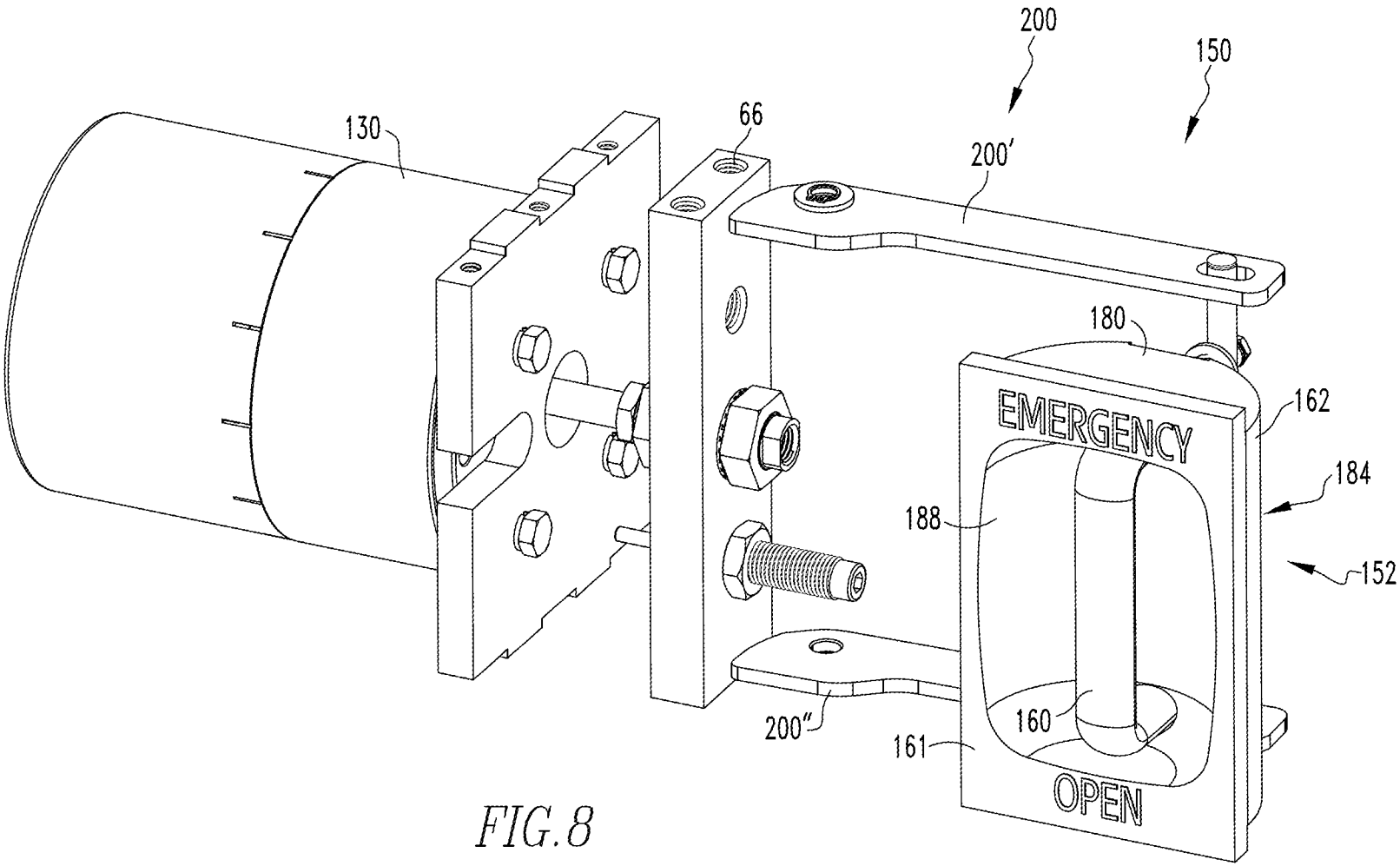
FIG. 8 is a detail, partial isometric view of a manual opening assembly.
Figure 9:
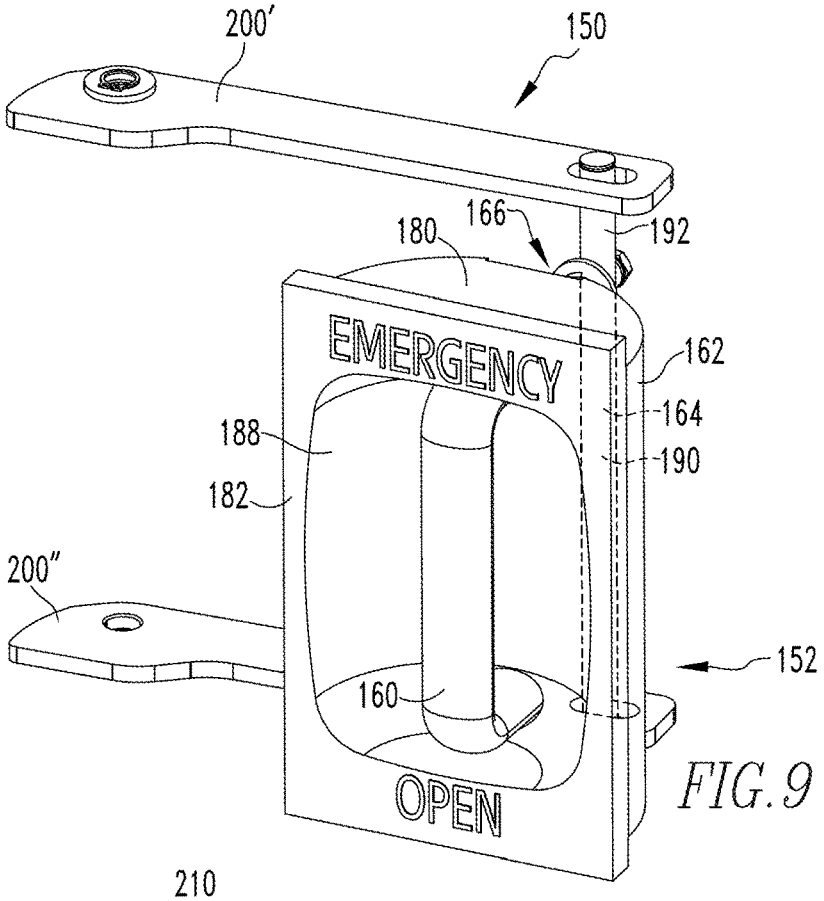
FIG. 9 is another detail, partial isometric view of a manual opening assembly.
Figure 10:
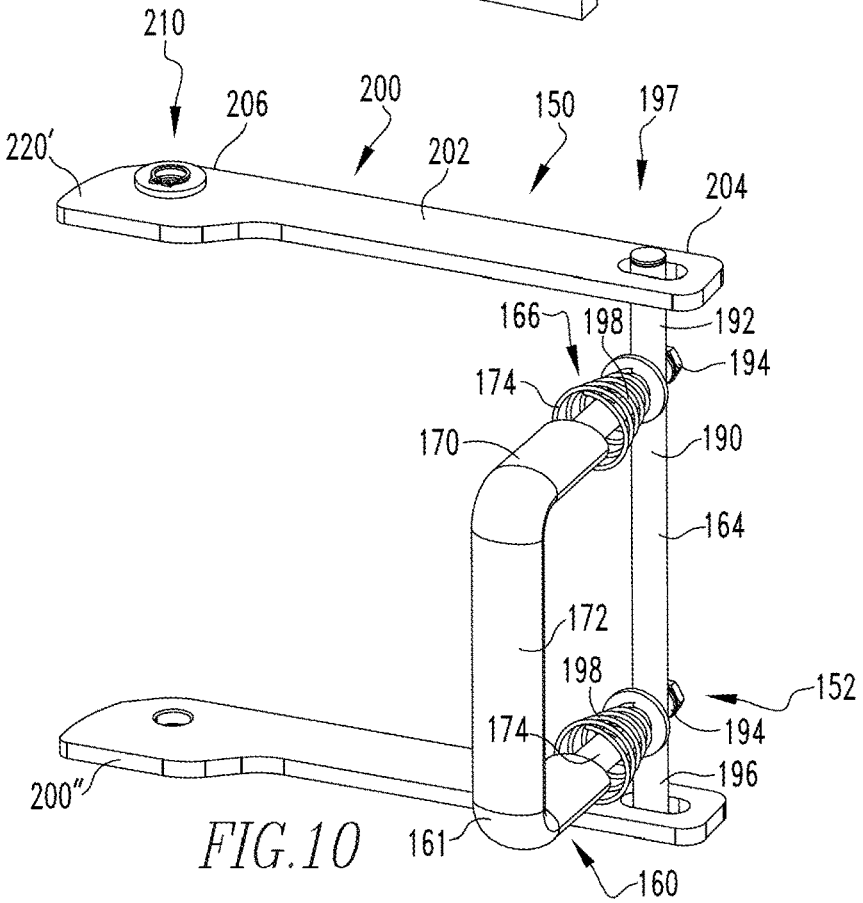
FIG. 10 is another detail, partial isometric view of a manual opening assembly.

In an exemplary embodiment, the control device 13 includes a manual opening assembly 150, as shown in FIGS. 8-10. The manual opening assembly 150 is structured to, and does, open the separable contacts 44, i.e., moves the separable contacts 44 from the second configuration to the first configuration, when the electromagnetic actuator 130 cannot be operated. The manual opening assembly 150 includes a manual actuator assembly 152. The manual actuator assembly 152 includes a handle assembly 160 and a number of operating levers 200.

The handle assembly 160 is structured to be, and is, movably coupled to the circuit breaker housing assembly 16 and moves between an operating position and an actuation position. The handle assembly 160 can be in the operating position regardless of the position/configuration of the electromagnetic actuator 130, the linkage assembly 60 and the separable contacts 44. Thus, this is not identified as the "second" position of the handle assembly 160. Generally, however, when the handle assembly 160 is disposed in the operating position, the handle assembly 160 is disposed in a retracted position and/or is disposed generally within the perimeter of the circuit breaker housing assembly 16.

In an exemplary embodiment, the handle assembly 160 includes a handle member 161, a housing 162, an elongated operating rod 164, and a return assembly 166. In an exemplary embodiment, the handle member 161 includes a generally U-shaped body 170 with extended tines. That is, the U-shaped body 170 includes a "bight," or middle portion, that is a grip 172. The tines of the U-shaped body 170 are elongated and identified herein as "connecting rods" 174.

The housing 162, in an exemplary embodiment, includes a generally concave sidewall including a generally planar rear portion, hereinafter "rear sidewall" 180. That is, the housing 162 defines a cavity 188. The rear sidewall 180 includes an exposed, first surface 182 and a rear, mounting surface 184. Further, the rear sidewall 180 defines a number of openings (not shown) sized to correspond to the connecting rods 174. The housing 162 is coupled, directly coupled, or fixed to the housing assembly 16 in a shielding position. As used herein, a "shielding position" means that the cavity of a concave housing is disposed within the general perimeter of a larger frame or housing. As used herein, "within the general perimeter" means that the smaller element is mostly within the perimeter of the larger element, but that some portions, such as, but not limited to, a rim may extend beyond the perimeter of the larger element.

The operating rod 164, in an exemplary embodiment, is an elongated body 190 including a first end 192, a number of medial coupling components 194, and a second end 196.

The return assembly 166 is structured to, and does, bias the handle assembly 160 to the operating position. In an exemplary embodiment, the return assembly 166 includes a number of biasing devices 197. In an exemplary embodiment, the return assembly number of biasing devices 197 is a number of return springs 198.

The handle assembly 160 is assembled as follows. The handle member 161 is disposed in the housing 162 with the grip 172 disposed in the cavity 188 and each connecting rod 174 extending through an opening in the rear sidewall 180. Each return spring 198 is disposed about a connecting rod 174 and compressed. The connecting rods 174 are then coupled to the operating rod coupling components 194. The springs are then released, but are still partially compressed between the operating rod 164 and the rear sidewall 180. In this configuration, the return assembly 166 biases the operating rod 164 away from the housing 162.

The handle assembly 160, and in an exemplary embodiment the operating rod 164, is operatively coupled to each operating lever 200. Each operating lever 200 includes an elongated body 202. Each operating lever body 202 include a first end 204 and a second end 206. Each lever body first end 204 is coupled to the handle assembly 160 and, in an exemplary embodiment, to the operating rod 164. Each lever body second end 206 includes a pivot coupling 210 and a nose 220. In an exemplary embodiment, as shown, there are two operating levers 200; a first operating lever 200' rotatably coupled to the upper planar member 17 and a second operating lever 200" rotatably coupled to the lower planar member 19. That is, each operating lever body 202 is coupled to the housing assembly 16 at the lever body second end pivot coupling 210. The lever body nose 220 extends in a direction away from both the lever body first end 204 and the lever body second end pivot coupling 210. Further, when assembled, each lever body nose 220 is disposed adjacent, or immediately adjacent, the yoke member 66 and on the side of the yoke member 66 opposite the electromagnetic actuator 130. In this arrangement, the operating levers 200 are structured to, and do, move between an operating position, wherein the operating levers 200 do not operatively engage the linkage assembly 60, and an opening position, wherein the operating levers 200 operatively engage the linkage assembly 60 and move the linkage assembly 60 from the second configuration to the first configuration.

The manual opening assembly 150 operates as follows. When the handle assembly 160 is in the operating position, each lever body nose 220 is disposed adjacent, or immediately adjacent, the yoke member 66. In an exemplary embodiment, when the handle assembly 160 is in the operating position each lever body nose 220 is spaced from the yoke member 66. When a user pulls the handle member 161, i.e., pulls on the grip 172, the handle member 161 operatively engages the operating rod 164 which, in turn, operatively engages the operating levers 200. When the operating levers 200 are operatively engaged, the operating levers 200 rotate about the lever body second end pivot coupling 210. Rotation of the operating levers 200 cause each lever body nose 220 to operatively engage the yoke member 66. When the yoke member 66 is operatively engaged, the yoke member 66 moves from the second position to the first position. This motion is transferred to the electromagnetic actuator 130 and overcomes the magnetic coupling of the magnetic member 140 and the fixed magnet 134. As described above, when the magnetic member 140 and the fixed magnet 134 are no longer magnetically coupled, the force from the bias assembly 110 causes the electromagnetic actuator 130 and the linkage assembly 60 to move to the first configuration. In turn, the linkage assembly 60 moves the separable contacts 44 to the first configuration. Thus, the separable contacts 44 are opened, i.e., moved to the first configuration, without energizing the electromagnetic actuator 130. This solves the problems stated above.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A manual opening assembly for a circuit breaker operating mechanism, said circuit breaker including a housing assembly, a number of pairs of separable contacts, and said operating mechanism, each pair of separable contacts structured to move between an open, first configuration, wherein the contacts in each pair of separable contacts are spaced from each other, and a second configuration, wherein the contacts in each pair of separable contacts are coupled to, and in electrical communication with, each other, said operating mechanism including a linkage assembly, a bias assembly, and an electromagnetic actuator, said linkage assembly structured to move between a first configuration and a second configuration, said linkage assembly operatively coupled to each pair of separable contacts, wherein, when said linkage assembly is in said first configuration, each pair of separable contacts are in the first configuration, and wherein, when said linkage assembly is in said second configuration, each pair of separable contacts are in the second configuration, said electromagnetic actuator is operatively coupled to said linkage assembly, said electromagnetic actuator structured to move between a first configuration and a second configuration corresponding to said linkage assembly first configuration and said second configuration, said electromagnetic actuator including a fixed magnet and an actuator assembly, said actuator assembly including a magnetic member and an elongated actuator member, said actuator member coupled to said magnetic member, said actuator assembly structured to move between a first position, wherein said magnetic member is spaced from said fixed magnet, and a second position, wherein said magnetic member is magnetically coupled to said fixed magnet, said bias assembly operatively coupled to said housing assembly and to said linkage assembly, said bias assembly biasing said linkage assembly to said first configuration, said manual opening assembly comprising:

a manual actuator assembly including a handle assembly and a number of operating levers;

said handle assembly including a handle member structured to be movably coupled to said circuit breaker housing and to move between an operating position and an actuation position;

said handle member operatively coupled to said number of operating levers;

said number of operating levers movably coupled to said circuit breaker housing assembly; and said operating levers structured to move between an operating position, wherein said operating levers do not operatively engage said linkage assembly, and an opening position, wherein said operating levers operatively engage said linkage assembly and move said linkage assembly from said second configuration to said first configuration.

2. The manual opening assembly of claim 1 wherein said handle assembly includes a housing, said handle assembly housing disposed in a shielding position.

3. The manual opening assembly of claim 2 wherein:

said handle assembly includes an elongated operating rod;

said handle assembly housing including a rear sidewall;

said rear sidewall including an exposed, first surface and a rear, mounting surface;

said handle member including a grip and a number of connecting rods;

said handle member number of connecting rods extending through said handle assembly housing rear sidewall;

said handle member operatively coupled to said operating rod; and said operating rod operatively coupled to said number of operating levers.

4. The manual opening assembly of claim 3 wherein:

said handle assembly includes a return assembly;

said return assembly including a number of biasing devices; and said biasing devices structured to bias said handle member to said operating position.

5. The manual opening assembly of claim 4 wherein:

said number of biasing devices includes a number of springs; and said number of springs disposed between said rear sidewall mounting surface and said operating rod.

6. The manual opening assembly of claim 5 wherein said number of springs are disposed about said handle member number of connecting rods.

7. The manual opening assembly of claim 1 wherein:

said number of operating levers includes a number of elongated lever bodies;

each lever body including a first end and a second end;

each lever body first end coupled to said handle assembly;

each lever body second end including a pivot coupling and a nose; and each said nose structured to operatively engage said linkage assembly.

8. A circuit breaker operating mechanism for a circuit breaker including a housing assembly and a number of pairs of separable contacts, each pair of separable contacts disposed in said housing assembly and structured to move between an open, first configuration, wherein the contacts in each pair of separable contacts are spaced from each other, and a second configuration, wherein the contacts in each pair of separable contacts are coupled to, and in electrical communication with, each other, said operating mechanism comprising:

a linkage assembly operatively coupled to each pair of separable contacts and structured to move between a first configuration and a second configuration wherein, when said linkage assembly is in said first configuration, each pair of separable contacts are in the first configuration, and wherein, when said linkage assembly is in said second configuration, each pair of separable contacts are in the second configuration;

a bias assembly operatively coupled to said housing assembly and to said linkage assembly, said bias assembly biasing said linkage assembly to said first configuration;

an electromagnetic actuator including a fixed magnet and an actuator assembly, said actuator assembly including a magnetic member and an elongated actuator member, said actuator member coupled to said magnetic member, said actuator assembly structured to move between a first position, wherein said magnetic member is spaced from said fixed magnet, and a second position, wherein said magnetic member is magnetically coupled to said fixed magnet;

said electromagnetic actuator member operatively coupled to said linkage assembly, wherein said electromagnetic actuator member positions correspond to said contact configuration;

a manual opening assembly including a manual actuator assembly;

said manual actuator assembly including a handle assembly and a number of operating levers;

said handle assembly including a handle member structured to be movably coupled to said circuit breaker housing assembly and to move between an operating position and an opening position;

said handle member operatively coupled to said number of operating levers;

said number of operating levers movably coupled to said circuit breaker housing assembly; and said operating levers structured to move between an operating position, wherein said operating levers do not operatively engage said linkage assembly, and an opening position, wherein said operating levers operatively engage said linkage assembly and move said linkage assembly from said second configuration to said first configuration.

9. The circuit breaker operating mechanism of claim 8 wherein said handle assembly includes a housing, said handle assembly housing disposed in a shielding position.

10. The circuit breaker operating mechanism of claim 9 wherein:

said handle assembly includes an elongated operating rod;

said handle assembly housing including a rear sidewall;

said rear sidewall including an exposed, first surface and a rear, mounting surface;

said handle member including a grip and a number of connecting rods;

said handle member number of connecting rods extending through said handle assembly housing rear sidewall;

said handle member operatively coupled to said operating rod; and said operating rod operatively coupled to said number of operating levers.

11. The circuit breaker operating mechanism of claim 10 wherein:

said handle assembly includes a return assembly;

said return assembly including a number of biasing devices; and said biasing devices structured to bias said handle member to said operating position.

12. The circuit breaker operating mechanism of claim 11 wherein:

said number of biasing devices includes a number of springs; and said number of springs disposed between said rear sidewall mounting surface and said operating rod.

13. The circuit breaker operating mechanism of claim 12 wherein said number of springs are disposed about said handle member number of connecting rods.

14. The circuit breaker operating mechanism of claim 8 wherein:

said number of operating levers includes a number of elongated lever bodies:

each lever body including a first end and a second end;

each lever body first end coupled to said handle assembly;

each lever body second end including a pivot coupling and a nose; and each said nose structured to operatively engage said linkage assembly.

15. A circuit breaker comprising:

a housing assembly;

a number of pairs of separable contacts, each pair of separable contacts disposed in said housing assembly and structured to move between an open, first configuration, wherein the contacts in each pair of separable contacts are spaced from each other, and a second configuration, wherein the contacts in each pair of separable contacts are coupled to, and in electrical communication with, each other;

an operating mechanism including a linkage assembly, a bias assembly, and an electromagnetic actuator;

said linkage assembly operatively coupled to each pair of separable contacts and structured to move between a first configuration and a second configuration wherein, when said linkage assembly is in said first configuration, each pair of separable contacts are in the first configuration, and wherein, when said linkage assembly is in said second configuration, each pair of separable contacts are in the second configuration;

said bias assembly operatively coupled to said housing assembly and to said linkage assembly, said bias assembly biasing said linkage assembly to said first position;

said electromagnetic actuator including a fixed magnet and an actuator assembly, said actuator assembly including a magnetic member and an elongated actuator member, said actuator member coupled to said magnetic member, said actuator assembly structured to move between a first position, wherein said magnetic member is spaced from said fixed magnet, and a second position, wherein said magnetic member is magnetically coupled to said fixed magnet;

said electromagnetic actuator member operatively coupled to said linkage assembly, wherein said electromagnetic actuator member positions correspond to said contact configuration;

a manual opening assembly including a manual actuator assembly;

said manual actuator assembly including a handle assembly and a number of operating levers; including a handle assembly and a number of operating levers;

said handle assembly including a handle member structured to be movably coupled to said circuit breaker housing assembly and to move between an operating position and an opening position;

said handle member operatively coupled to said number of operating levers;

said number of operating levers movably coupled to said circuit breaker housing assembly;

said operating levers structured to move between an operating position, wherein said operating levers do not operatively engage said linkage assembly, and an opening position, wherein said operating levers operatively engage said linkage assembly and move said linkage assembly from said second configuration to said first configuration.

16. The circuit breaker of claim 15 wherein said handle assembly includes a housing, said handle assembly housing disposed in a shielding position.

17. The circuit breaker of claim 16 wherein:

said handle assembly includes an elongated operating rod;

said handle assembly housing including a rear sidewall;

said rear sidewall including an exposed, first surface and a rear, mounting surface;

said handle member including a grip and a number of connecting rods;

said handle member number of connecting rods extending through said handle assembly housing rear sidewall;

said handle member operatively coupled to said operating rod; and said operating rod operatively coupled to said number of operating levers.

18. The circuit breaker of claim 17 wherein:

said handle assembly includes a return assembly;

said return assembly including a number of biasing devices; and said biasing devices structured to bias said handle member to said operating position.

19. The circuit breaker of claim 18 wherein:

said number of biasing devices includes a number of springs; and said number of springs disposed between said rear sidewall mounting surface and said operating rod.

20. The circuit breaker of claim 19 wherein said number of springs are disposed about said handle member number of connecting rods.

21. The circuit breaker of claim 15 wherein:

said number of operating levers includes a number of elongated lever bodies;

each lever body including a first end and a second end;

each lever body first end coupled to said handle assembly;

each lever body second end including a pivot coupling and a nose; and each said nose structured to operatively engage said linkage assembly.

* * * * *